United States Patent [19]

Laureano

[11] 4,192,536

[45] Mar. 11, 1980

[54] PUSH-PULL DOOR LATCH

[75] Inventor: Angel F. Laureano, Bayamon, P.R.

[73] Assignee: Bel Air Aluminum Manufacturing, Inc., Hato Rey, P.R.

[21] Appl. No.: 924,238

[22] Filed: Jul. 13, 1978

[51] Int. Cl.[2] ..... E05C 3/30

[52] U.S. Cl. ..... 292/228; 292/244

[58] Field of Search ..... 292/244, 228, 207, 208, 292/357

[56] References Cited

U.S. PATENT DOCUMENTS

| | | | |
|---|---|---|---|
| 2,726,108 | 12/1955 | Falk | 292/228 X |
| 2,733,089 | 1/1956 | Grenengoed | 292/228 X |
| 2,757,033 | 7/1956 | Noca | 292/357 X |

*Primary Examiner*—Richard E. Moore

*Attorney, Agent, or Firm*—Paul A. Weilein

[57] ABSTRACT

A push-pull latch mechanism for screen doors, storm doors, and the like, in which a casing pivotally supporting a double-ended handle is mounted within an opening extending between the opposite surfaces of the door adjacent its swinging edge, the handle having a latch dog in offset relation to the pivot, inner and outer escutcheon plates having openings for receiving the handle ends therethrough, the escutcheon plates being securable to the opposite surfaces of the door independently of the casing, one of the escutcheon plates incorporating a manually operable member that is movable into dogging and non-dogging positions with respect to the handle, and in the dogging position being operative to oppose movement of the latch dog from its latching position. The casing and handle are arranged for mounting as a unit assembly on the door, and the escutcheon plates are selectively interchangeable in a manner to enable the latch mechanism components to be assembled in selective different combinations enabling use of the latch merchanism on "in" or "out" swinging doors, as well as "left" or "right" hand doors.

16 Claims, 8 Drawing Figures

FIG. 1.
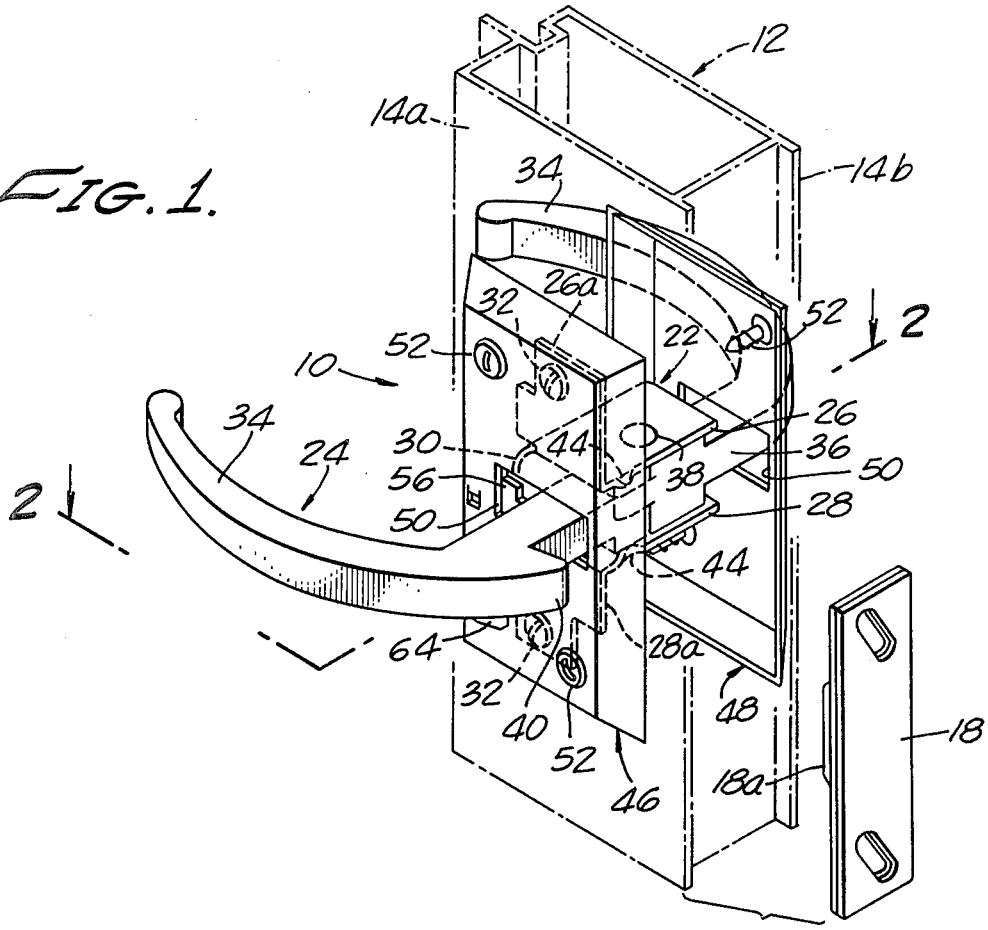
FIG. 2.
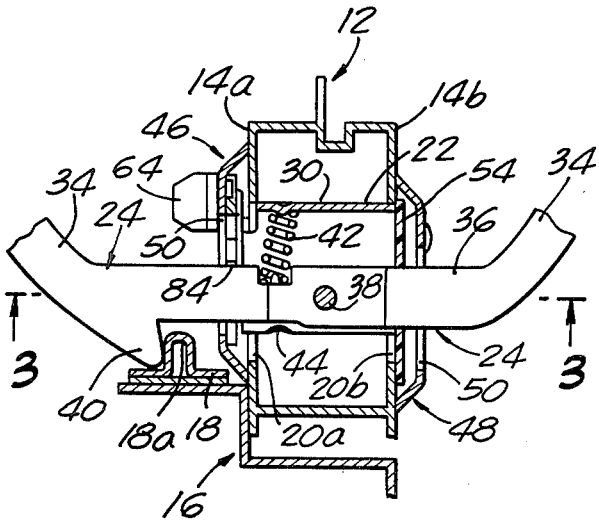
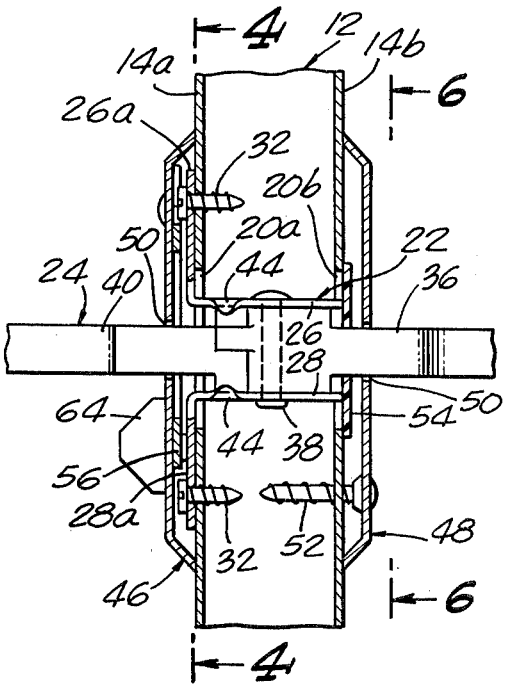
FIG. 3.

PUSH-PULL DOOR LATCH

BACKGROUND OF THE INVENTION

The present invention relates generally to the field of security latching mechanisms.

In recent years, a variety of latch mechanisms have been conceived and utilized for screen doors, storm doors, and the like, in which a swingably supported handle engageable from opposite sides of the door is utilized to releasably actuate a spring-urged latch from a latching position to a non-latching position.

One such known embodiment is disclosed in U.S. Pat. No. 2,317,300 in which a tubular casing is adapted to fit snugly within a cylindrical aperture in the door, this casing having an integrally formed escutcheon plate for one side of the door extending at right angles, and a double-ended handle extending through the tubular casing and intermediately pivoted for movement of an associated latch dog into an operative position by a compression spring. The escutcheon plate mounts a swingable lock piece that may be manually moved to a position opposing movement of the latch dog out of its operative position. In this patent arrangement, it is readily apparent that the latch mechanism is limited with respect to installations in which the manually operable lock piece and latch dog are located on the same side of the door. There are installations in which it may be desirable to have the manually operable lock piece on the opposite side of the door from that of the latch dog.

The present invention provides an improvement in latch mechanisms, as exemplified by the above patent, and provides a combination of components which are so designed and arranged that they can be operatively assembled, without limiting their function and operating efficiency, to meet a variety of different installation requirements. The components are readily susceptible of assembly for use on in or out swinging doors, as well as for right and left hand doors. The latch mechanism of the present invention might therefore be aptly referred to as a "4-ways" latch mechanism.

This installation versatility of the present invention is made possible by a unique unit assembly of a casing and pivotally supported double-ended handle with a latch dog, which is selectively mountable on the door in relatively reversible positions, and by the provision of interchangeable escutcheon plates which are supported on the door independently of the casing and handle unit, one of the escutcheon plates mounting a manually operable dogging member for opposing movement of the handle in an unlatching direction, irrespective of whether such one escutcheon plate is mounted on the inner or outer surface of the door.

SUMMARY OF THE INVENTION

The present invention is more particularly concerned with a push-pull door latch mechanism in which the components can be variably assembled to meet different installation requirements.

To such end, it is one object of the present invention to provide an improved latch mechanism of the push-pull type in which the components can be selectively assembled for use on in or out swinging doors, and upon left or right hand doors.

A further object is to provide a door latch mechanism having independently mountable escutcheon plates which are selectively interchangeable, and wherein one of the escutcheon plates mounts a manually operable dogging member for opposing unlatching.

Another object is to provide a door latch mechanism of the push-pull type having a manually operable dogging member that is movable in a vertical direction to a dogging position, and which is functionally retained in the dogging position, and which is so arranged that it cannot fail into a lock-out position.

Further objects and advantages of the invention will be brought out in the following part of the specification, wherein detailed description is for the purpose of fully disclosing a preferred embodiment of the invention without placing limitations thereon.

BRIEF DESCRIPTION OF THE DRAWINGS

Referring to the accompanying drawings, which are for illustrative purposes only:

FIG. 1 is a partially exploded perspective view showing the manner of mounting a latch mechanism according to the present invention on an extruded tubular door frame;

FIG. 2 is a fragmentary transverse sectional view, taken substantially on line 2—2 of FIG. 1;

FIG. 3 is a fragmentary vertical sectional view, taken substantially on line 3—3 of FIG. 2;

DESCRIPTION OF A PREFERRED EMBODIMENT

Figure 4:
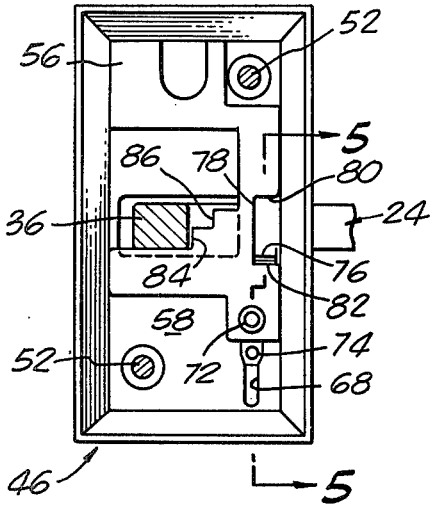
FIG. 4 is a vertical sectional view, taken substantially on line 4—4 of FIG. 3, and showing the rear face of the escutcheon plate and the manually operable dogging means thereon.

Referring more specifically to the drawings, for illustrative purposes, the invention is shown in FIG. 1 as comprising a latch mechanism, as generally indicated by the numeral 10, which is mounted on the free edge of a swinging door, which may be assumed to be a screen door or storm door hinged in the usual manner, and in this case having an extruded tubular frame, as generally indicated by the numeral 12, and as having oppositely facing outer surfaces **14*a* and 14*b*. The free edge of the door, as shown in FIG. 2, is arranged to close against a rabbet of an associated door frame, as generally indicated at 16, and which mounts an appropriate strike 18, this strike being provided with a projecting rib portion 18*a***.

The latch mechanism is mounted near the free edge of the door within axially aligned circular openings **20*a*, 20*b*, respectively, in the outer surfaces 14*a* and 14*b* of the extruded frame 12. These openings are, of course, of appropriate size to receive a U-shaped casing frame 22 therethrough. This casing frame operatively supports a double-ended handle, as generally indicated by the numeral 24, and is fabricated from a flat sheet to provide spaced parallel leg portions 26 and 28 which are connected on one side by a bridging portion 30. Corresponding ends of the leg portions 26 and 28 are extended to provide oppositely extending right angled mounting wings 26***a* and 28*a* which are adapted, in the mounted position of the casing frame, to bear against an outer surface of the extruded frame 12, in this case the surface 14*a*, and to be secured by appropriate retaining screws 32. As thus mounted, it will be noted that the open end of the U-shaped casing 22 is positioned in facing relation to the free edge of the door structure.

The double-ended handle 24 is preferably of one-piece solid construction, and is of generally C-shaped configuration, being formed with curved end handle portions 34 which are connected at their inner ends by an intermediate substantially straight portion 36. The handle extends between the leg portions 26 and 28 of the casing frame and is swingably supported by a pivot 38 in its straight portion 36. Externally of the frame 12, a latch dog 40 is provided at one end of the straight portion 36 for latching engagement with the projecting portion 18*a* of the strike 18, when the door is in closed position. As shown in FIG. 2, the latch dog 40 is in offset relation to the pivot 38, and the double-ended handle 24 is urged towards a latching position of the latch dog by means of a compression coiled spring 42, which extends between the straight portion 36 of the handle and the bridging portion 30 of the casing. Swinging movement of the handle is limited by suitable stop means which is shown as comprising a deflected edge portion 44 on each of the casing leg portions 26 and 28. It will be apparent that the latch dog 40, as shown in FIG. 2, may be moved to an unlatched position with respect to the strike 18 by pushing against the curved handle portion 34 which is adjacent the latch dog 40, or by pulling on the other curved handle portion 34.

After the casing frame 22 and handle 24 assembled unit is mounted in its operative position, the installation is completed by securing the escutcheon plates 46 and 48, respectively, in association with opposite ends of the double-ended handle 24 after passing each end through a rectangular opening 50 provided in the escutcheon plate. The escutcheon plates are formed from sheet material and are of generally rectangular dished configuration with peripheral outwardly sloping edge walls. The plates are retained in mounted position by means of retaining screws 52 which are located in the corner areas of the plates so as to clear the underlying wing portions 26*a* and 28*a*, when an escutcheon plate is mounted thereover. Before installing the escutcheon plate 48, a shielding washer 54 of rubber or other appropriate material is threaded over this end of the handle and positioned between the escutcheon plate and the adjacent end of the casing frame 22.

Figure 5:
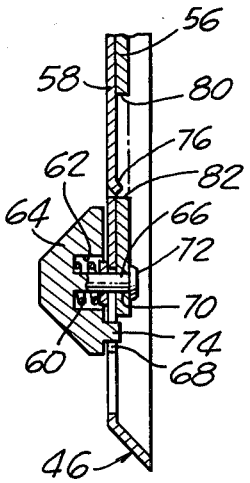
FIG. 5 is an enlarged fragmentary sectional view, taken substantially on line 5—5 of FIG. 4, and showing mounting details of portions of the manually operable dogging means.
Figure 6:
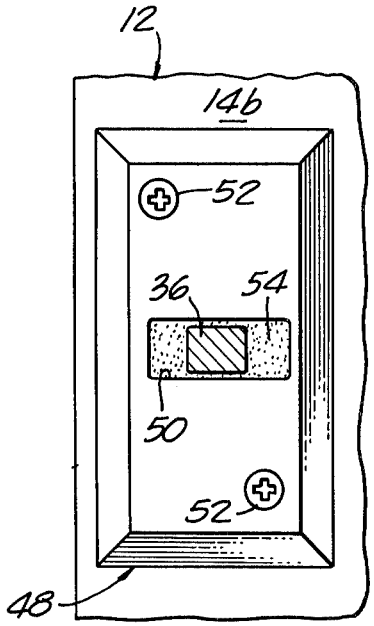
FIG. 6 is a fragmentary elevational view of the other escutcheon plate as viewed on line 6—6 of FIG. 3.

The escutcheon plates 46 and 48 have in general the same external appearance, but in the case of the escutcheon plate 46, this plate serves an additional function of providing a support and mounting for a manually operable means for dogging the handle 24 against movement in a direction to move the latch dog 40 out of engagement with the strike 18. As best shown in FIGS. 4 and 5, the manually operable dogging means comprises a dogging slide plate 56 which is mounted in face engagement with the back surface of a bottom wall 58 of the escutcheon plate 46. The dogging slide plate is urged into frictional engagement with the bottom wall 58 by means of a coiled spring 60 which is positioned within a cavity 62 of an exposed actuator button 64. An integrally formed stem portion 66 extends axially of the cavity 62 through a vertically extending guide slot 68 formed in the wall 58 of the escutcheon plate. The rear end of the stem portion 66 also extends through an appropriate opening 70 in the plate 56 and is headed as indicated at 72 to retain the the actuator button in its mounted position. The spring 60 surrounds the stem portion 66 and is confined within the cavity 62 with one end bearing against the bottom of the cavity and its other end in engagement with a washer 72 which is forcibly urged by the spring against the adjacent outer surface of the bottom wall 58 of the escutcheon plate. The actuator button is retained against rotation by means of a guiding projection 74 positioned for movement longitudinally of the guide slot 68.

Vertical movements of the dogging slide plate 56 are further controlled by a struck-out rearwardly extending projecting finger 76 which is adapted to guidingly engage an edge 78 of a cutout portion 80 of the dogging slide plate 56. In addition to its guiding function, the finger 76 also provides a stop which is engageable by a cutout edge 82 to limit the upper sliding movement of the dogging slide plate 56.

Figure 7:
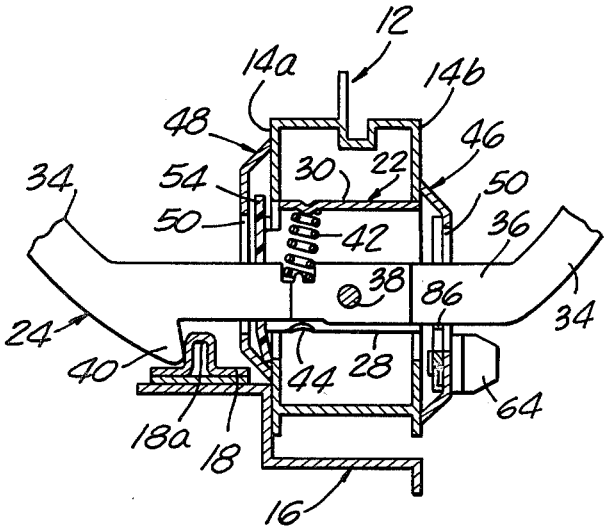
FIG. 7 is a fragmentary transverse sectional view similar to FIG. 2, but showing the escutcheon plates in interchanged positions from those shown in FIG. 2.
Figure 8:
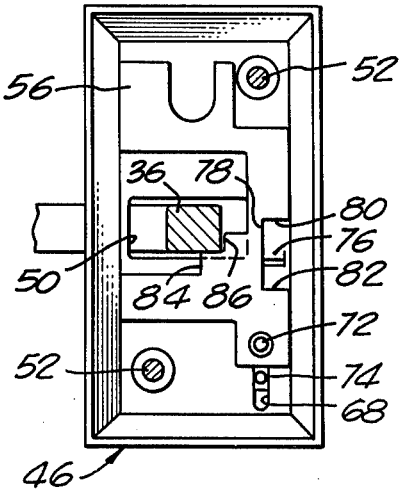
FIG. 8 is a vertical sectional view similar to FIG. 4, and showing the relationship of the dogging means with the handle, in the interchanged position shown in FIG. 7.

An important feature of the present invention resides in the provision for interchangeability of the escutcheon plates 46 and 48. For example, FIGS. 1, 2 and 3 illustrate a mounting in which the escutcheon plate 46 is adjacent the latch dog 40, and the escutcheon plate 48 is mounted on the opposite side of the door. FIG. 7 illustrates the positions of these escutcheon plates after they have been interchanged. Referring now to FIGS. 4 and 8, it will be seen that the dogging slide plate 56 is formed to provide a pair of laterally offset stepped portions that define abutment edges 84 and 86 which are selectively engageable with the handle portion 36, in the respective interchanged positions of the escutcheon plates, to dog the handle against movement to an unlatched position. As shown in FIG. 4, when the escutcheon plate 46 is in the position shown in FIG. 2, the edge 84 engages the handle portion 36, whereas, when the escutcheon plate 46 is in the position shown in FIG. 7, the edge 86 engages the handle portion 36 as best shown in FIG. 8.

From the above description, it will be apparent that the escutcheon plate 46, in whatever its installed position may be, will support the dogging slide plate so as to always be moved vertically upwardly into a dogging position where it is frictionally retained by the action of spring 60. To move the plate 56 to a non-dogging position, the plate will always be moved downwardly. Thus, the dogging plate will always move to a fail-safe position in which the handle may manipulate the latch dog to a non-latching position. That is to say, the mechanism cannot fail-safe into a lock-out position.

From the foregoing description and drawings, it will be clearly evident that the delineated objects and features of the invention will be accomplished.

Various modifications may suggest themselves to those skilled in the art without departing from the spirit of the disclosed invention and, hence, it is not wished to be restricted to the specific form shown or uses mentioned, except to the extent indicated in the appended claims.

I claim:

1. A push-pull latch mechanism for mounting on a screen door, storm door and the like having a cylindrical opening adjacent its swinging edge extending between opposite facing surfaces thereof, comprising:

(a) a casing frame adapted to fit within the cylindrical opening;

(b) means for securing the casing in an operative position within said opening including casing portions engageable with one of said opposite facing surfaces;

(c) a double-ended handle extending through said casing and being pivoted thereto, said handle having a projecting latch dog in offset relation to the pivot;

(d) means within the casing for urging the handle and latch dog towards a latching position; and (e) interchangeable inner and outer escutcheon plates securable to the opposite surfaces of the door independently of said casing, said plates respectively having an opening for receiving a handle end therethrough.

2. A latch mechanism according to claim 1, which includes:

manually operable means carried by one of said escutcheon plates selectively movable in its interchanged positions into dogging and non-dogging positions of engagement and disengagement by said handle, and in the dogging position being operative to oppose handle movement of the latch dog from said latching position.

3. A latch mechanism according to claim 2, in which said manually operable means comprises:

a dogging plate slidably supported on the inner surface of said one of said escutcheon plates for sliding movement and has a part operable to engage and disengage the handle respectively in said dogging and non-dogging positions.

4. A latch mechanism according to claim 3, in which:

said dogging plate is guidingly constrained for rectilinear movement between a raised dogging position and a lowered non-dogging position.

5. A latch mechanism according to claim 4, in which:

said dogging plate has an edge cutout portion; and said escutcheon plate has a projecting portion positioned in said cutout providing a stop for terminating the raising movement of the dogging plate at said dogging position.

6. A latch mechanism according to claim 2 which includes:

means for interchangeably mounting said one of said escutcheon plates on said opposite door surfaces; and said manually operable means comprises an abutment projection supported for movement into and out of a path of engagement by said handle when moved in a direction to move the latch dog from said latching position.

7. A latch mechanism according to claim 6, in which:

said abutment projection is respectively positioned to operably engage opposite sides of the associated handle portion, when said one escutcheon plate is selectively changed from its mounted position on one surface of the door to the other surface.

8. A latch mechanism according to claim 7, wherein:

said abutment projection is formed with a stepped edge having laterally offset edge portions; one of said edge portions being operably engageable with the associated handle portion in one of the selected mounting positions of said one of said escutcheon plates, and the other of said edge portions being operably engageable with the associated handle portion in the other of the selected mounting positions of said one of said escutcheon plates.

9. A latch mechanism according to claim 6, in which:

the abutment projection is supported for said movements in a vertical path.

10. A latch mechanism according to claim 9, including:

means for resiliently resisting the movements of said abutment projection.

11. A latch mechanism according to claim 3, in which:

spring means urges said dogging plate against the inner surface of said one of said escutcheon plates.

12. A latch mechanism according to claim 1, in which:

said casing is transversely U-shaped and mounted with its open end facing the swinging edge of the door;

said handle is pivoted between the legs of the casing, and the casing portions comprise oppositely extending right angled mounting wings integrally formed on the legs of the U-shaped casing.

13. A latch mechanism according to claim 12, in which:

each of said escutcheon plates is of a size sufficient to conceal said mounting wings.

14. A latch mechanism according to claim 16, in which:

the double-ended handle is generally C-shaped and has an intermediate straight portion extending between the legs of the casing and being supported on a pivot positioned so that the straight portion extends on opposite sides of the pivot; and the handle urging means includes a spring in offset relation to said pivot extending between the handle and the closed end of the U-shaped casing.

15. A latch mechanism according to claim 14, in which:

an abutment stop at an end of one leg of the U-shaped casing limits the pivotal movement of said handle by said spring.

16. A latch mechanism according to claim 11, in which:

a shielding washer member surrounds the handle and is positioned between the other of said escutcheon plates and the casing.

* * * * *